United States Patent [19]

Heet

[11] 4,075,921

[45] Feb. 28, 1978

[54] STRING INSTRUMENT VIBRATION INITIATOR AND SUSTAINER

[76] Inventor: Gregory S. Heet, 611 Ducommun St., Los Angeles, Calif. 90012

[21] Appl. No.: 746,690

[22] Filed: Dec. 2, 1976

Related U.S. Application Data

[63] Continuation of Ser. No. 595,597, July 14, 1975, abandoned.

[51] Int. Cl.[2] ..... G10H 3/00

[52] U.S. Cl. ..... 84/1.16; 84/1.15

[58] Field of Search ..... 84/1.14, 1.15, 1.16, 84/312, DIG. 10, DIG. 20, DIG. 24; 179/1 M

[56] References Cited

U.S. PATENT DOCUMENTS

| | | | |
|---|---|---|---|
| 2,229,189 | 1/1941 | Rice | 84/1.16 |
| 2,455,567 | 12/1948 | Armond | 84/1.16 |
| 2,725,778 | 12/1955 | Cronwell | 84/1.16 |
| 3,290,425 | 12/1966 | Stobaugh | 84/1.16 |
| 3,525,797 | 8/1970 | Pavia | 84/1.15 |
| 3,539,700 | 11/1970 | Johnson | 84/1.15 X |
| 3,742,113 | 6/1973 | Cohen | 84/1.15 X |
| 3,763,736 | 10/1973 | Williams | 84/1.15 X |
| 3,813,473 | 5/1974 | Terymenko | 84/1.16 |
| 3,869,952 | 3/1975 | Rowe | 84/1.16 |
| 3,911,777 | 10/1975 | Rendell | 84/1.16 |

*Primary Examiner*—E. S. Jackmon

*Attorney, Agent, or Firm*—Blakely, Sokoloff, Taylor & Zafman

[57] ABSTRACT

An apparatus for initiating and sustaining vibrations of a string in a musical instrument. A hand-held (or permanently mounted) device senses the vibration of the string and provides an output driving signal for sustaining the vibrations.

14 Claims, 11 Drawing Figures

STRING INSTRUMENT VIBRATION INITIATOR AND SUSTAINER

This is a continuation of application Ser. No. 595,597, filed July 14, 1975 which is now abandoned.

BACKGROUND OF THE INVENTION

1. Field of the Invention

The invention relates to the field of devices for enhancing and sustaining the sounds of string instruments.

2. Prior Art

Initiating the vibrations of a string instrument has been accomplished through manual plucking, the use of standard hair bows (as in violin), electric motor driven bows (as in player violins), and occasionally through speaker feedback (as in electric guitars). Sustaining the vibrations of a stringed instrument has been accomplished again through speaker feedback (as in electric guitars), various amplifiers, compressors and "fuzz" boxes (distortion boosters) and electric motor driven bows. Each of these has its limitations including distortion; and in the case of some electronic means the sustained period is limited to the decay time of the string.

The present invention introduces a new degree of control over sound quality not possible with prior art systems. As will be seen the invented device will smoothly initiate the vibrations in a metal string (without distortion), and sustain the vibrations in this string again without distortion, without adding noise inherent in many prior art techniques. However, the device may distort vibrations, if desired, and drive only overtones of the string, suppressing the tonic (or basic frequency of the string). Moreover, the vibrations of a string (or multiplicity of strings) may be sustained as long as desired. Unusual sounds may also be obtained with the disclosed system not possible with comparably priced prior art systems. Since the disclosed system is easily controlled (manually), the duration, intensity, attack-time, etc. of the sounds are easily varied.

SUMMARY OF THE INVENTION

An apparatus for initiating, sustaining and enhancing the vibrations of a string in a musical instrument is disclosed. In one embodiment, a hand-held device, positioned above a vibrating string in an instrument, senses the vibrations of the string. The sensed vibrations are electrically amplified, and then coupled to a coil which is used to drive the same string. Where the apparatus is used for a guitar, a pair of coils for sensing and driving a string are located within a channel defined by a housing. Guides for engaging other strings are disposed at the opposite edges of the channel allowing the channel to be readily positioned over a selected string. In another embodiment pickup coils and driving coils are permanently located adjacent to the strings of an instrument. The switching mechanism for activating the driving coils in this embodiment generally resemble the strings of the instrument.

As will be seen the present invention provides a relatively inexpensive, convenient means for obtaining new and unusual sounds from a string instrument, such as a guitar. In one embodiment the apparatus is hand-held and does not require any additions or alterations to the string instrument.

Figure 5:
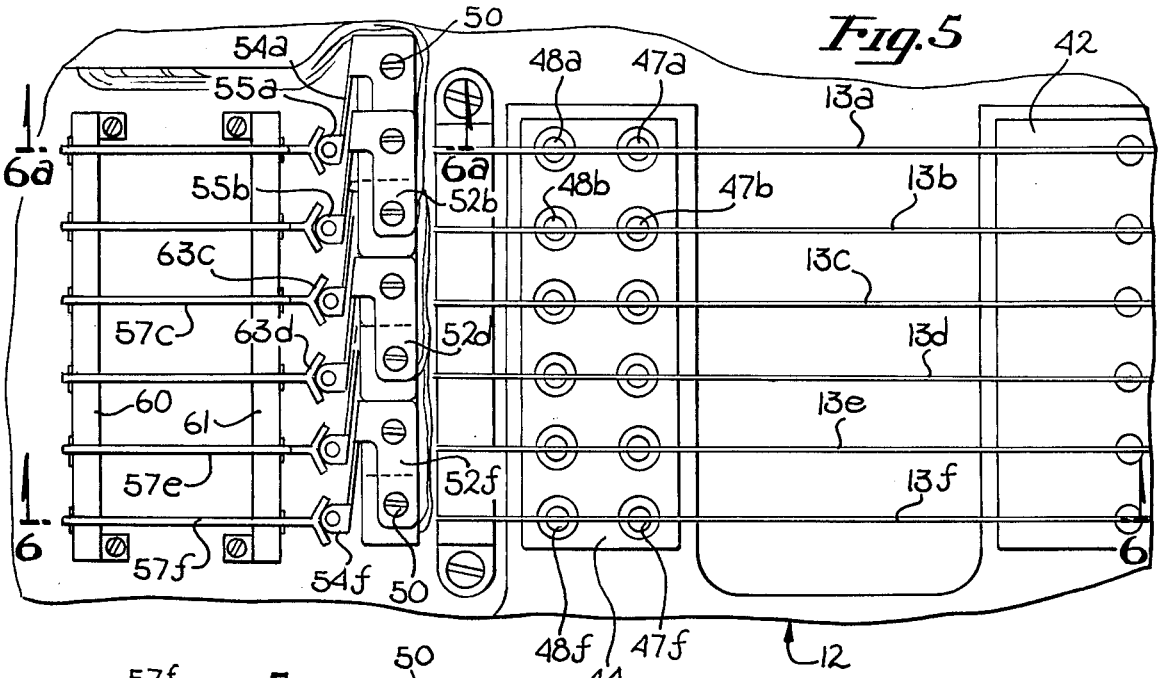
FIG. 5 is a plan view of the embodiment of the invention where sustainers are part of a guitar, this view illustrates the finger rod mechanisms by which the sustainers are activated.

FIG. **6*a* is a partial cross-sectional side view of the guitar of FIG. 5 taken through section line 6*a*—6*a* of FIG. 5**.

Figure 6:
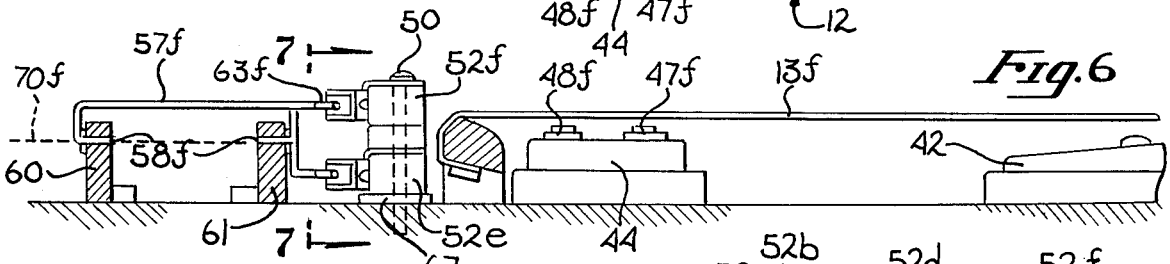
FIG. 6 is a cross-sectional side view of the section of the guitar of FIG. 5 taken through section line 6—6 of FIG. 5.
Figure 7:
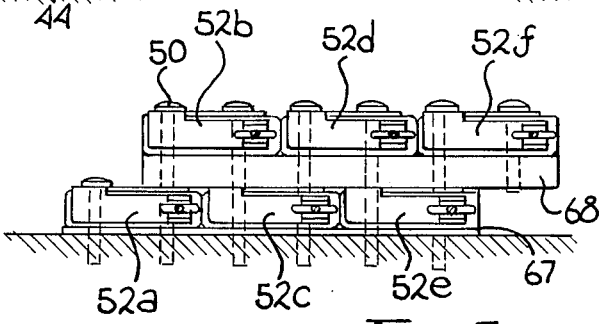

FIG. 7 is a cross-sectional end view of the guitar shown in FIG. 5 taken through section lines 7—7 of FIG. 6.

Figure 8:
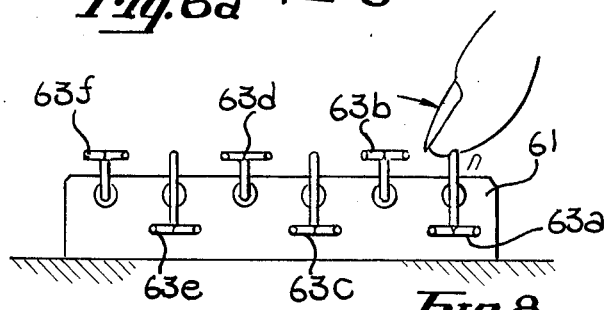

FIG. 8 is a cross-sectional end view of the guitar of FIG. 5 taken through section lines 8—8 of FIG. **6*a***.

Figure 9:
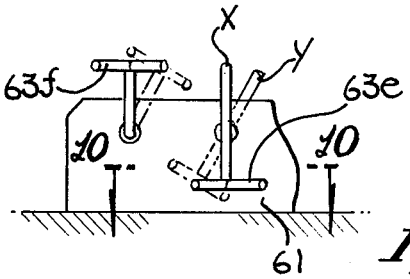
Figure 10:
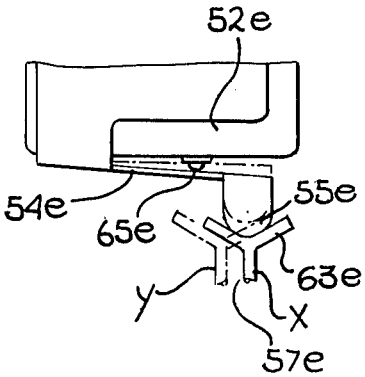

FIG. 9 is a partial section of FIG. 8 used to illustrate the motion of the finger rods, and FIG. 10 is a partial end view of a portion of the guitar shown in FIG. 9 taken through section 9—9 of FIG. 10.

DETAILED DESCRIPTION OF THE INVENTION

An apparatus for initiating and sustaining the vibrations of a string or strings in a musical instrument is described. The presently preferred embodiment is disclosed in conjunction with a guitar, but as will be apparent, the invented system will work equally well on other string instruments. As the system is presently implemented steel strings, or ferromagnetic strings, are used in a musical instrument since the vibrations may be readily sensed and sustained with magnetic fields.

Figure 1:
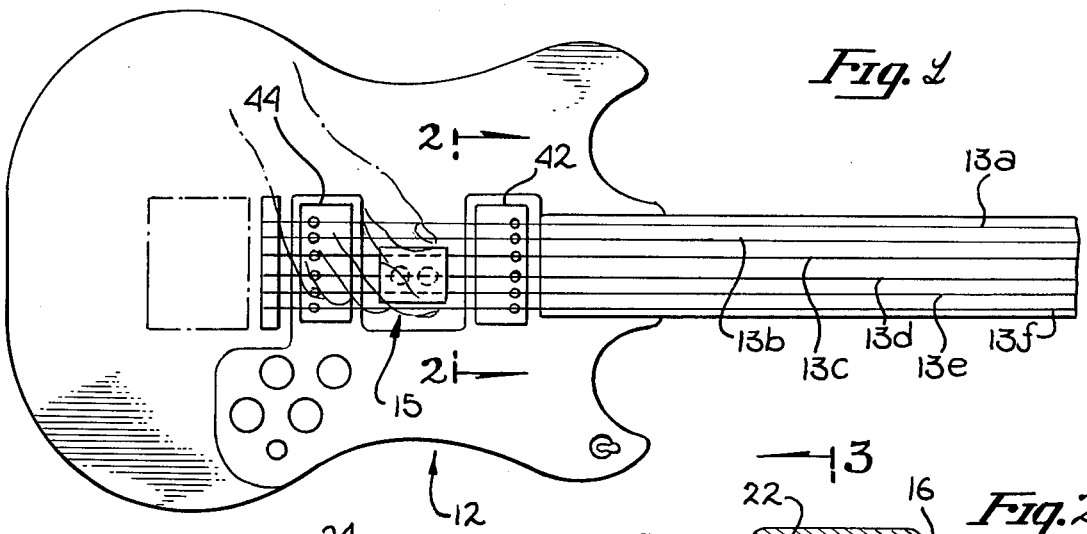
FIG. 1 is a plan view of a section of an electric guitar.

Referring first to FIG. 1 and the six-stringed, electric guitar illustrated therein, the guitar includes generally parallel, coplanar strings **13*a*, 13*b*, 13*c*, 13*d*, 13*e*, and 13*f*. A pickup board 42 associated with a prior art electric guitar is also illustrated as part of guitar 12, however, the presently invented system may be utilized on a non-electric guitar or electric guitar. Two embodiments of the invention are illustrated in FIG. 1 (however, several other embodiments are discussed). One version of a hand-held sustainer 15 is shown in FIG. 1 over string 13*d*. This hand-held sustainer may be applied selectively to any string of the guitar or other musical instrument. Also, in FIG. 1 the guitar 12 includes a sustainer system, built in accordance with the present invention, which is incorporated into guitar 12. A sustainer base plate 44** which includes a plurality of input and output coils is utilized as part of this embodiment.

Figure 2:
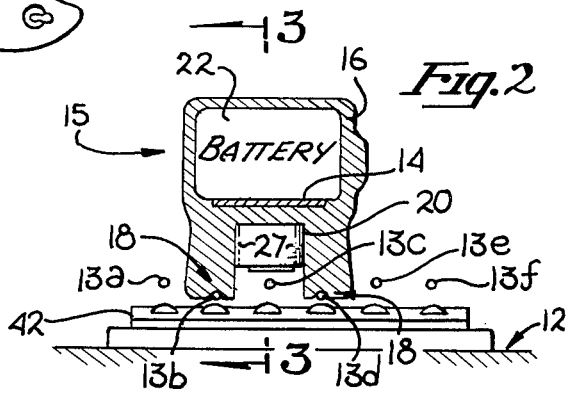
FIG. 2 is a cross-sectional view of the hand-held embodiment of the present invention where the hand-held sustainer is positioned above guitar strings. The view of FIG. 2 is taken generally through section lines 2—2 of FIG. 1.
Figure 3:
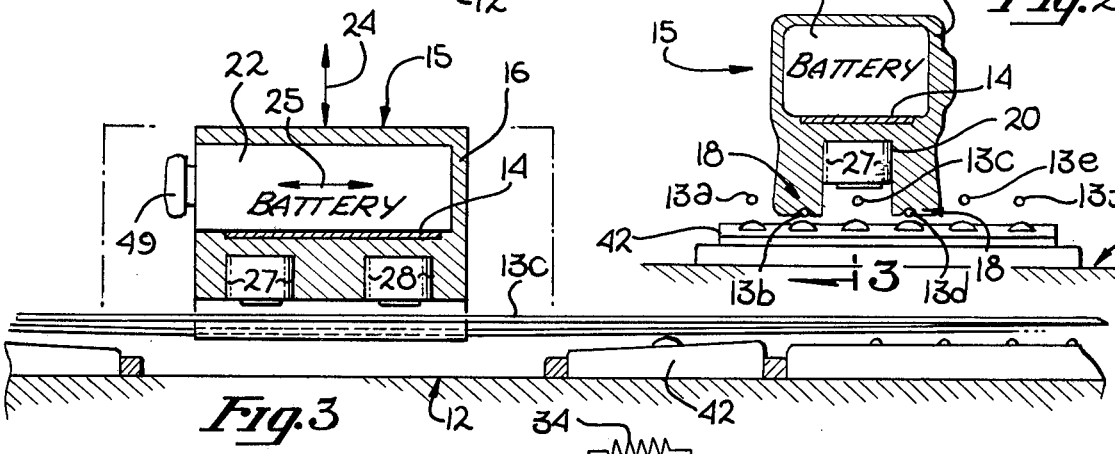
FIG. 3 is a cross-sectional view of the sustainer and guitar of FIG. 2 taken through section line 3—3 of FIG. 2.

Referring first to FIGS. 2 and 3, the hand-held sustainer 15 comprises a generally rectilinear housing 16 which forms a channel 20. The housing 16 along opposite edges of the channel 20 defines a pair of parallel, elongated string guides 18. These spaced apart guides 18 are disposed such that when they engage strings of the guitar, a third string is disposed within the center of the channel. For example, as shown in FIG. 2 guides 18 are engaging string **13*b* and 13*d*, while channel 20 straddles string 13*c*. In the presently preferred embodiment the housing 16** may be a molded plastic member adaptable for being held in the hand.

The major components of the sustainer 15, in addition to the housing 16, are a battery 22, an input coil 27, an output coil 28, and a circuit board 14. The coils 27 and 28 are disposed in-line within the channel 20, parallel with the grooves 18, such that the coils are disposed above a string when the guides 18 are engaging adjacent strings. For example, in FIG. 2 while guides 18 are engaging strings **13*b* and 13*d*, string 13*c* is disposed directly below both coils 27 and 28. As is apparent, the sustainer 15 may be moved such that the channel 20 is disposed above any of the strings 13*a* through 13*f*, however, when the channel 20 is disposed above either strings 13*a* or 13*f*, only a single guide 18** will be engaging a string.

Figure 4:
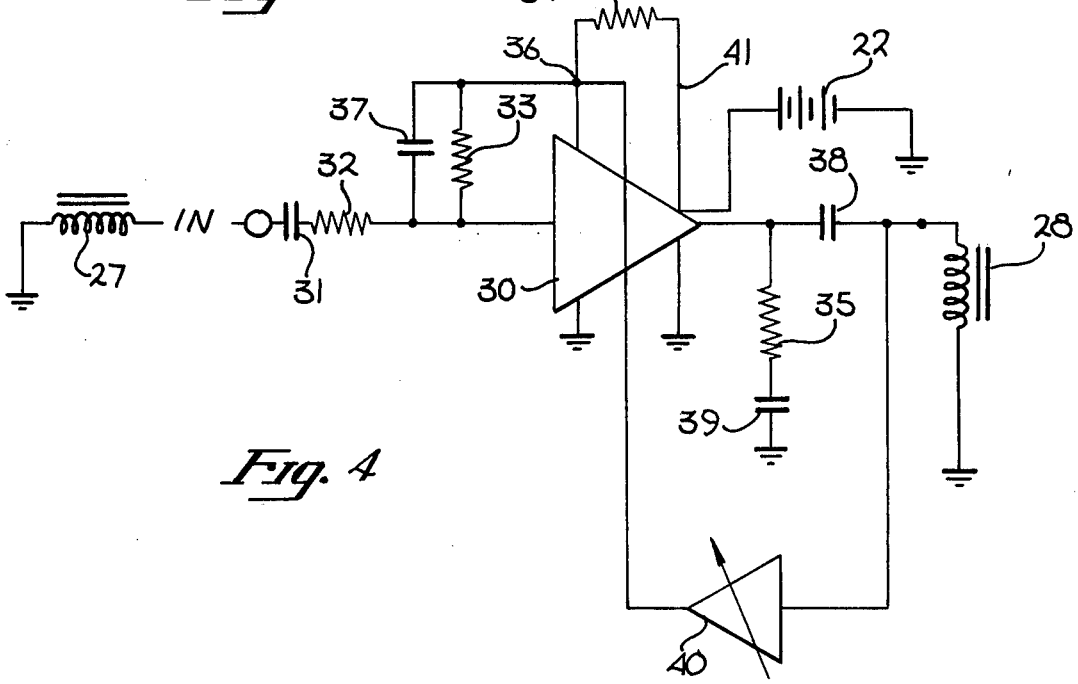
FIG. 4 is a circuit diagram illustrating the circuit utilized in the sustainer.

In the presently preferred embodiment, the circuit of FIG. 4 is fabricated on circuit board 14 which is disposed within housing 16 between the battery 22 and channel 20. The hybrid circuit of FIG. 4 includes integrated circuit amplifiers 30 and 40 and discrete components for the other circuit elements of FIG. 4.

The circuit of FIG. 4 includes an operational amplifier 30 which may be anyone of a plurality of commercially available operational amplifiers. The input to the amplifier 30 is coupled from one terminal of coil 27 through capacitor 31 and resistor 32. The input terminal of amplifier 30 is also coupled to terminal 36 of the amplifier through the parallel combination of resistor 33 and capacitor 37. Terminal 36 is coupled to terminal 41 of amplifier 30 through a resistor 34. The terminal 41 is also coupled to one terminal of the battery 22. The output of the amplifier is coupled to ground through the series combination of resistor 35 and capacitor 39, and is also coupled to one terminal of the output coil 28. In one embodiment the driving signal applied to coil 28 is feedback through a variable gain amplifier 40 to terminal 36 of operational amplifier 30. The gain of amplifier 40 is controlled manually by knob 49 shown in FIG. 3. In the presently preferred embodiment both coils 27 and 28 include permanent magnetic cores of ALNICO-5, and the battery 22 comprises a nine volt battery. It will be apparent to one skilled in the art that any one of a plurality of other amplifier circuits may be utilized in lieu of the circuit of FIG. 4. While in the presently preferred embodiment a pair of coils is used, a single coil may be used for both sensing the movement of the string and for driving the string. For applications where only the sustaining of vibrations (not initiation of vibrations) is desired, electrical threshold means may be placed at the input of amplifier 30 to prevent the feedback of small signal (or noise) which initiate the vibrations. The threshold means may be selectively coupled to the circuit by a manual switch.

Assume that the circuit of FIG. 4 is activated within the sustainer 15, and that the sustainer is positioned above string **13*c* on the guitar as shown in FIGS. 2 and 3, such that the magnetic field associated with the magnets of coils 27 and 28 cut across string 13*c*. If string 13*c* is plucked causing it to vibrate, its movement will be sensed by coil 27 since its movement causes the magnetic field associated with coil 27 to change thereby inducing a current in coil 27. The electrical signal generated within coil 27 is amplified by operational amplifier 30 and produces a varying magnetic field of the same frequency in coil 28. The magnetic field of coil 28 drives the string 13*c* at its resonant frequency, thereby sustaining the vibrations of the string. If string 13*c*** is not immediately plucked after the sustainer is in place, the sustainer (because of positive feedback) will cause the string to vibrate. The grooves of the sustainer may be used to generally align the coils with the string, and once this alignment is achieved the sustainer may be pressed down against the spring action of these strings to obtain various effects.

Referring to FIG. 3 by moving the sustainer 25 both transverse to the directions of the strings as shown by arrow 24 and/or parallel with the strings as shown by arrow 25, the intensity and other characteristics of the sound produced by the sustainer 15 may be varied. Also, where amplifier 40 is utilized the intensity of the sound may be adjusted through knob 49. In one embodiment an unusual effect is produced where the current through the output coil 28 is reversed. In such cases it has been found that the fundamental frequency of the string is damped, however the overtones or harmonics are driven and become more pronounced. A manual switch may be used to permit selections of this effect. Other unusual sounds and effects are obtained by manipulating the sustainer 15, for example, in a vibrato action.

While in FIGS. 2 and 3 the sustainer is shown having a pair of guides or grooves for straddling a single string; a single guide may be used. Moreover, more than a single string may be straddled if the grooves are so spaced apart and the channel between the grooves may contain a plurality of pickup and driving coils.

In FIG. 5 a sustainer base plate 44 which may be a plastic, metal or wooden member is fastened to the upper surface of the guitar 12 and includes a plurality of input coils **48*a* through 48*f*, and a plurality of output or driver coils 47*a* through 47*f*. These coils are mounted on the sustainer baseplate 44 in pairs, such that a single input and a single output coil are in-line and beneath each string of the guitar; for example, coils 47*b* and 48*b* are disposed below string 13*b*. An amplifier means not illustrated which may be identical to, or substantially similar to, the circuit of FIG. 4** interconnects each pair of input and output coils.

The sustainer associated with each string 13 includes an input coil 48, output coil 47, amplifier means, switch 52 and finger rod 57. The plurality of switches 52 are utilized to allow manual selection of each sustainer by one of the finger rods 57. The finger rods **57*a* through 57*f* are disposed in a general parallel in-line manner with their respective strings 13*a* through 13*f*. In the presently preferred embodiment each of the rods 57** are relatively thin such that they have the "feel" of a guitar string.

A bank of the switches 52, best seen in FIG. 7, is disposed on the surface of the guitar between the guitar's bridge and the rods 57. Switches **52*a*, 52*c* and 52*e* are mounted close to the surface of the guitar on a switchplate 67 while switches 52*b*, 52*d*, and 52*f* are mounted spaced apart from the other switches by a spacer 68. The switches are generally bolted or fastened to the guitar by bolts, or screws 50, tape, or the like. Each switch is used to activate its respective output coil when its finger rod has been selected. That is, by way of example, when rod 57*f* is manually selected, switch 57*f* activates coil 47*f* such that vibration in spring 13*f*** are sustained.

Figure 6A:
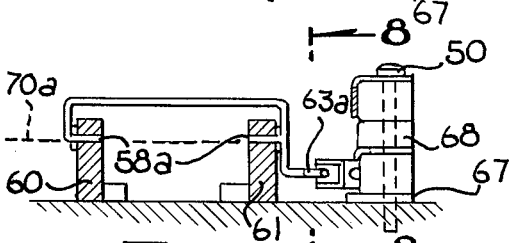

The rods 57 each include generally U-shaped coplanar ends 58 which are mounted within pivot blocks 60 and 61. The pivot blocks 60 and 61 which are mounted parallel to the bank of switches and transverse to the rods, include a plurality of apertures for receiving the rod ends. Referring to FIG. 6, rod 57*f* is shown with ends 58*f* disposed within the blocks 60 and 61 such that rod 57*f* is pivotally mounted about pivot axis 70*f*. In FIG. 6*a* rod 57*a* is shown with its ends 58*a* disposed again in the block 60 and 61 such that the rod 57*a* pivots about axis 70*a*.

Each of the rods include a curved roller guide 63 which is adaptable for engaging a roller 55 of the switches. Referring briefly to FIG. 10 the guide 63*e*, which is an integral part of rod 57*e*, is shown engaging a roller 55*e*. The roller 55*e* is coupled to one end of the switch arm 54*e*. The switch arm 54*e* abuts a contact pin 65*e*, thereby activating switch 52*e* when the arm is moved. Referring to FIGS. 6 and 8, the roller guides 63*b*, 63*d*, and 63*f* are mounted in a co-linear manner with their respective rods 57*b*, 57*d*, and 57*f* in order that these guides may cooperatively engage the upper set of switches 52*b*, 52*d*, and 52*f* shown in FIG. 7. Referring to FIG. 6*a* and FIG. 8, the roller guides 63*a*, 63*c*, and 63*e* are disposed below the pivot axes of rods 57*a*, 57*c*, and 57*d* such that these roller guides may cooperatively engage the lower set of switches 52*a*, 52*c*, and 52*e*, respectively.

Referring to FIGS. 5, 8, 9 and 10 it is apparent that when a finger rod 57 is moved in either direction about its pivot axis its switch arm 54 will be moved, thereby activating the associated drive coil. Referring specifically to FIG. 10, by way of example, when the rod 57*e* is moved from position X to position Y, the roller 55*e* will be urged inwardly toward switch 52*e* causing the pin 65*e* to move into switch 52*e*. The movement of pin 65*e* completes the circuit between the input coil 48*e* and output coil 47*e* through the connecting amplifier means. Thus if 13*e* is set into motion the string will continue to vibrate as was the case with the hand-held embodiment of the invention. Since the finger rods activate their respective switch when moved in either direction, the rods have the same general "feel" as the strings of the instrument. Of course, more simplified switching means may be used if maintaining the "feel" of the strings is not required.

While in FIG. 5 one switch is used for each string, this is not necessary. For example, a single switch may be used to activate all the initiators/sustainers associated with the strings. Moreover, a single pick-up coil may be large enough to sense movement in a plurality of strings. A single amplifier may also be used to replace the plurality of amplifiers discussed in conjunction with the embodiment of FIG. 5 and amplify the vibrations of more than one string. Where the threshold means previously mentioned is used a switch may not be necessary. The string, for this case, is set in motion by plucking, or the like, and manually clamped.

Thus, a sustaining system for a string instrument has been disclosed in both a hand-held embodiment and a more permanently mounted embodiment. The sound of a vibrating string is enhanced and may be initiated and sustained with the invented system with increased control and a decrease in distortion, at a lower cost.

I claim:

1. An apparatus for initiating or sustaining the vibration of at least one string of a musical instrument having a plurality of generally parallel, spaced apart, coplanar strings comprising:

a housing adaptable for being hand-held, said housing defining a channel;

at least one pair of coils disposed within said channel of said housing;

guide means comprising a pair of parallel guides defined by said housing and disposed on opposite edges of said channel such that when said pair of guides engage alternate strings said channel straddles at least one intermediate string; and, amplifier means having an input coupled to one of said coils and an output coupled to the other of said coils;

whereby said intermediate string may be set in motion by said amplifier means and coils and said motion is sustained by said amplifier means and coils.

2. The apparatus defined by claim 1 including a battery disposed within said housing and coupled to said amplifier means.

3. The apparatus defined by claim 2 wherein said strings comprise a ferromagnetic material and wherein said coils include permanent magnets.

4. An apparatus for initiating, sustaining and varying vibrations of strings in a musical instrument having at least a first and a second string comprising:

a hand-holdable housing for manual manipulation adjacent to said strings;

said housing including total circuit means providing electromagnet coupling between said apparatus and said strings for initiating, sustaining and varying the vibrations of said strings without additional electrical devices;

said circuit means including coil means for picking up the vibrations of one of said strings and for driving said same string, amplifier means coupled to said coil means, and power supply means coupled to said amplifier;

guide means coupled to said housing for positioning said housing with respect to said first string to permit manual manipulation of said housing with respect to said second string and for maintaining said coil means in alignment with respect to said second string during manual manipulation;

whereby by the manipulation of said housing a plurality of sound effects may be obtained.

5. The apparatus defined by claim 4 wherein said coil means includes a pair of coils, one of said coils being a pickup coil, the other coil being a driving coil.

6. The apparatus defined by claim 4 wherein said housing includes a channel formed in its bottom surface, said channel being of sufficient length and depth to receive therein said string being vibrated.

7. The apparatus defined by claim 6 wherein said coil means include a pickup coil and a driving coil, said coils being disposed in said channel and in alignment with said longitudinal axis of said channel.

8. The apparatus defined by claim 4 wherein said housing includes a channel formed in its bottom surface for positioning said coil means therein and for receiving a string to be vibrated in aligned relationship with said coil means.

9. The apparatus defined by claim 6 wherein said guide means are formed in the bottom surface of said housing in spaced parallel relationship to said channel.

10. The apparatus defined by claim 9 wherein said guide means comprise a groove located on opposite sides of said channel.

11. The apparatus defined by claim 8 wherein said guide means are formed in the bottom surface of said housing in spaced parallel relationship to said channel.

12. The apparatus defined by claim 11 wherein said guide means includes parallel grooves, said channel being positioned therebetween, the distance between each of said grooves and said channel corresponding to the distance between the strings of said musical instrument.

13. The apparatus defined by claim 5 wherein said amplifier means includes an input coupled to one of said coils and an output coupled to the other of said coils.

14. The apparatus defined by claim 4 wherein said power supply means is a battery.

* * * * *